US007794030B2

(12) United States Patent
Peng et al.

(10) Patent No.: US 7,794,030 B2
(45) Date of Patent: Sep. 14, 2010

(54) LATCH MECHANISM FOR SLIDE RAIL ASSEMBLY

(75) Inventors: Wen-Tang Peng, Taipei Hsien (TW); Mo-Ming Yu, Shenzhen (CN); Zong-Yuan Li, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 607 days.

(21) Appl. No.: 11/778,075

(22) Filed: Jul. 16, 2007

(65) Prior Publication Data

US 2008/0079342 A1 Apr. 3, 2008

(30) Foreign Application Priority Data

Sep. 29, 2006 (CN) ..... 2006 1 0200948

(51) Int. Cl.
*A47B 88/04* (2006.01)

(52) U.S. Cl. ..... 312/334.46; 312/333

(58) Field of Classification Search ..... 312/330.1, 312/333, 334.1, 334.7, 334.8, 334.11, 334.44, 312/334.46, 334.47; 384/18, 21, 22
See application file for complete search history.

(56) References Cited

U.S. PATENT DOCUMENTS

| | | | | |
|---|---|---|---|---|
| 6,412,891 | B1 * | 7/2002 | Liang et al. | 312/334.44 |
| 6,935,710 | B2 * | 8/2005 | Chen et al. | 312/333 |
| 6,945,619 | B1 * | 9/2005 | Chen et al. | 312/334.47 |
| 2005/0116594 | A1 * | 6/2005 | Barry et al. | 312/334.4 |

* cited by examiner

*Primary Examiner*—James O Hansen
(74) *Attorney, Agent, or Firm*—Frank R. Niranjan

(57) ABSTRACT

A latch mechanism is provided for retaining a slide rail assembly, which includes first and second slide rails. The latch mechanism includes a latch module movably carried by the second slide rail, a stop member arranged on the first slide rail, a first release member and a second release member slidably attached to the second slide rail. The latch module includes a first stop surface and a second stop surface at opposite sides thereof. Two protrusions extend from the stop member at diagonally opposite corners thereof configured to respectively engage with the first and second stop surfaces of the latch module for retaining the second slide rail relative to the first slide rail. The first and second release members capable of selectively driving the latch module to slide the latch module to release the first or second stop surface from the corresponding protrusions of the stop member.

19 Claims, 14 Drawing Sheets

LATCH MECHANISM FOR SLIDE RAIL ASSEMBLY

BACKGROUND OF THE INVENTION

1. Field of the Invention

The present invention relates to a latch mechanism for a slide rail assembly.

2. Description of Related Art

Slide rails are used in a variety of applications, including business furniture, kitchen drawers, electronic racks, and copiers. One type of slide rail is a telescopic slide rail. Telescopic slide rails often include two, three, four or more telescoping members. The shape of a slide rail, and the individual members, are determined by the design. The slides can be frictional, with lubricated members rubbing against each other, or a slide assembly may include roller or ball bearings for easier movement. The members in such assemblies tend to be C-shaped in nature.

A conventional three-section slide rail assembly for a drawer, includes a first slide rail (e.g. outer slide rail), a second slide rail (e.g. middle slide rail), and a third slide rail (e.g. inner slide rail). A ball rail is sandwiched between any two of the first slide rail, the second slide rail, and the third slide rail to provide a smooth sliding movement. Moreover, the third slide rail and the second slide rail mount a retaining member and a stop member respectively to prevent the slide rails extending too far. The retaining member is attached to an inner surface of the third slide rail, and provided with an inclined wall. The stop member is mounted to a front end of the second slide rail, and provided with a protrusion. To prevent users from drawing the third slide rail out too far from the second slide rail, the protrusion of the stop member engages with the inclined wall of the retaining member.

Users can draw out a keyboard or a component, which is attached to the third slide rail, for servicing. Although the engagement of the stop member with the inclined wall avoids the release of the third slide rail from the second slide rail by accident, it cannot prevent the third slide rail retracting into the second slide rail too far by careless force of users. Therefore, it is inconvenient to users for operating the slide rail assembly in use.

Consequently, it is required to provide a slide rail assembly which can overcome the above problem.

SUMMARY OF THE INVENTION

In one embodiment, a latch mechanism is provided for retaining a slide rail assembly, which includes first and second slide rails. The latch mechanism includes a latch module movably carried by the second slide rail, a stop member arranged on the first slide rail, a first release member and a second release member slidably attached to the second slide rail. The latch module includes a first stop surface and a second stop surface at opposite sides thereof. Two protrusions extend from the stop member at diagonally opposite corners thereof configured to respectively engage with the first and second stop surfaces of the latch module for retaining the second slide rail relative to the first slide rail. The first and second release members capable of selectively driving the latch module to slide the latch module to release the first or second stop surface from the corresponding protrusions of the stop member.

Other advantages and novel features of the present invention will become more apparent from the following detailed description of preferred embodiment when taken in conjunction with the accompanying drawings, in which:

DETAILED DESCRIPTION OF THE INVENTION

Figure 1:
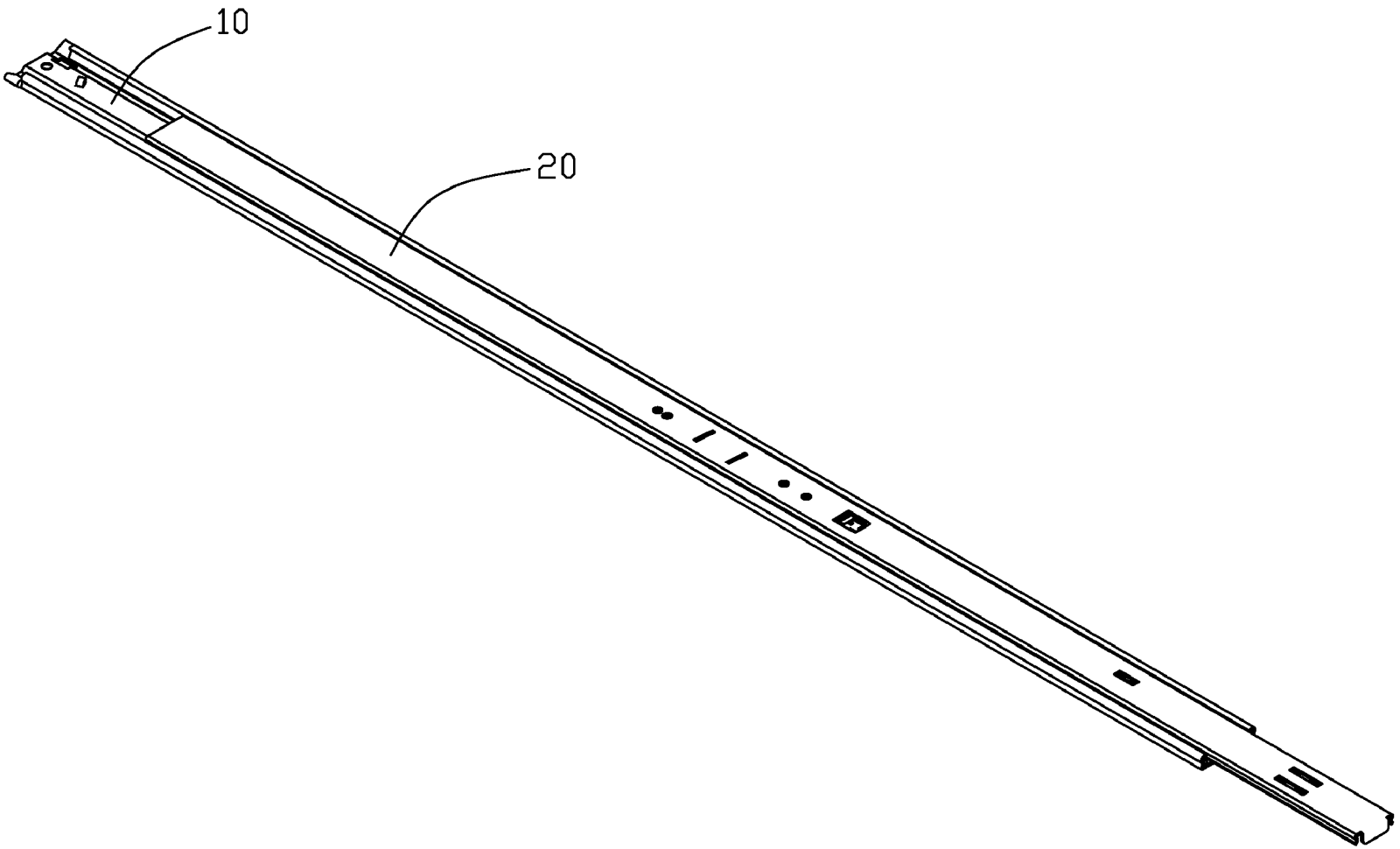
FIG. 1 is an assembled view of a slide rail assembly according to a preferred embodiment of the present invention.
Figure 2:
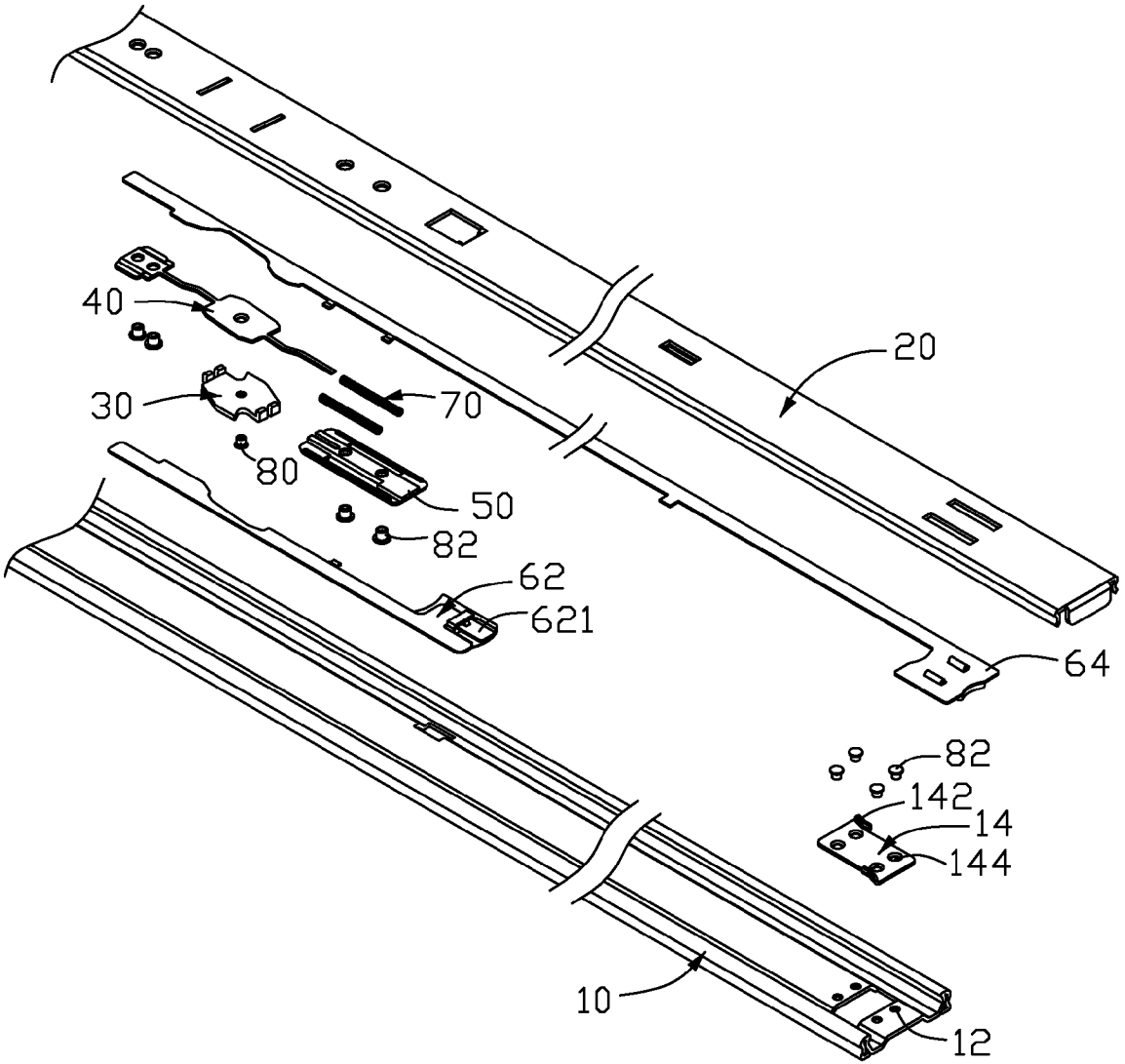
FIG. 2 is an exploded, isometric partial view of FIG. 1.

Referring to FIGS. 1 and 2, in an embodiment of the invention, a latch mechanism is provided for retaining a slide rail assembly which includes a first slide rail 10, and a second slide rail 20. The latch mechanism includes a latch module, a mounting member 50, a first release member 62, a second release member 64, two resilient members 70, a plurality of fasteners such as rivets 80, and 82, and a stop member 14 mounted on the first slide rail 10. In this embodiment, the latch module includes a latch member 30, and a connecting member 40.

The first slide rail 10 has an elongate body. Four mounting holes 12 are defined in one end of the elongate body. The stop member 14 is a generally rectangular piece. Two protrusions 142 extend from two diagonally opposite corners of the stop member 14. Four through holes 144 are defined in the stop member 14. The stop member 14 is mounted to the first slide rail 10 via four rivets 82 extending through the through holes 144 and engaging in the mounting holes 12 of the first slide rail 10.

Figure 3:
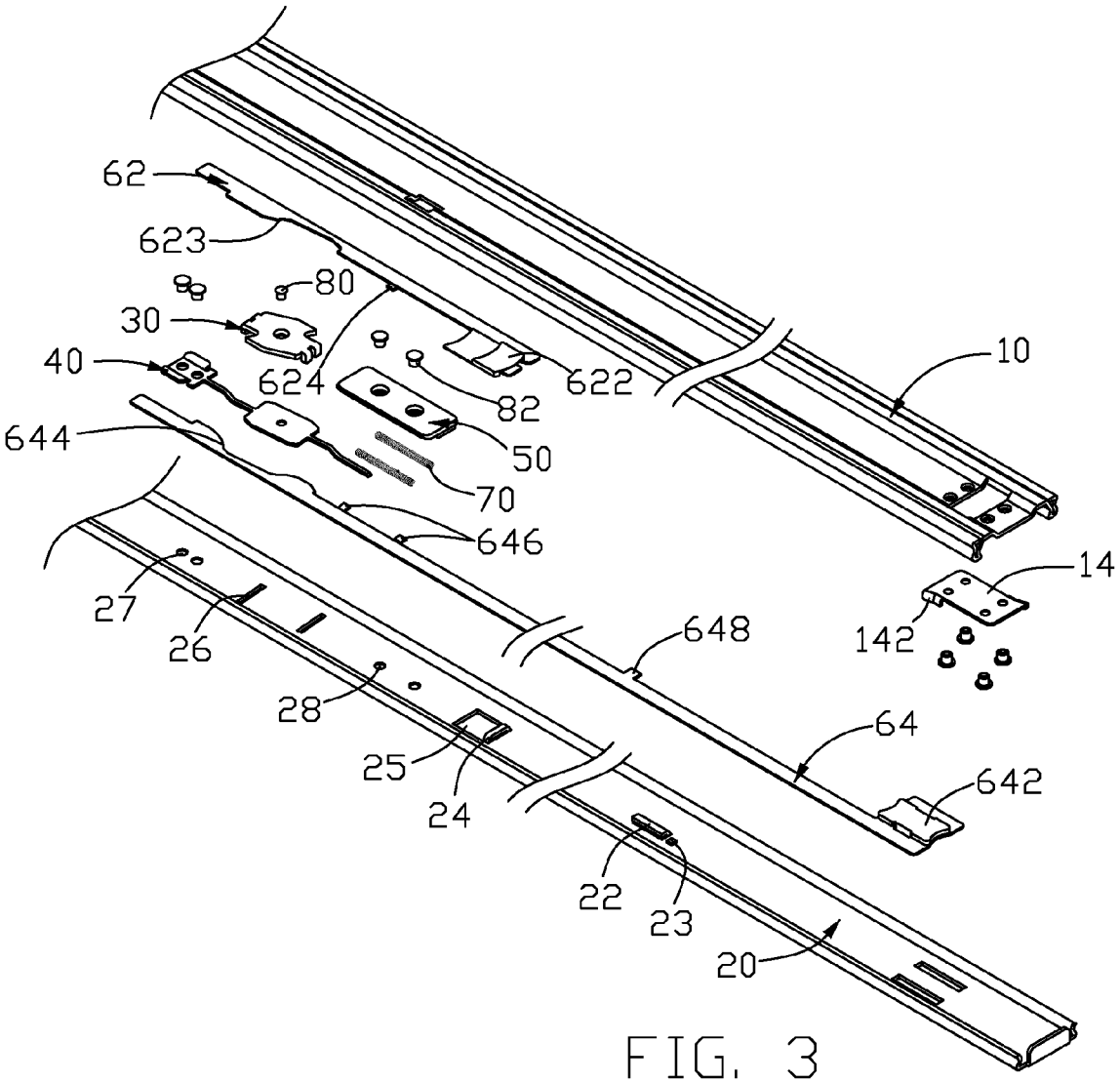
FIG. 3 is an inverted view of FIG. 2.

Referring also to FIG. 3, the second slide rail 20 has an elongate body, and includes a base wall and two sidewalls extending from two sides of the base wall in a longitudinal direction of the second slide rail 20. An L-shaped bent tab 22 extends from the base wall of the second slide rail 20 toward one of the sidewalls of the second slide rail 20. A block 23 is formed on the base wall of the second slide rail 20 in the vicinity of one end of the bent tab 22. Two parallel sliding slots 26 are defined in the base wall of the second slide rail 20 away from the bent tab 22 at a predetermined retaining position of the second slide rail 20 and the first slide rail 10. In this embodiment, the sliding slots 26 are angled with the longitudinal direction of the second slide rail 20, and not perpendicular to the longitudinal direction. Two pairs of mounting holes 27, 28 are defined in the base wall of the second slide rail 20 beside the sliding slots 26 respectively. A quadrate slot 25 is defined in the base wall of the second slide rail 20 in the vicinity of the mounting holes 28. An arch-like fixed portion 24 is formed on the base wall of the second slide rail 20 adjacent to the quadrate slot 25.

Figure 4:
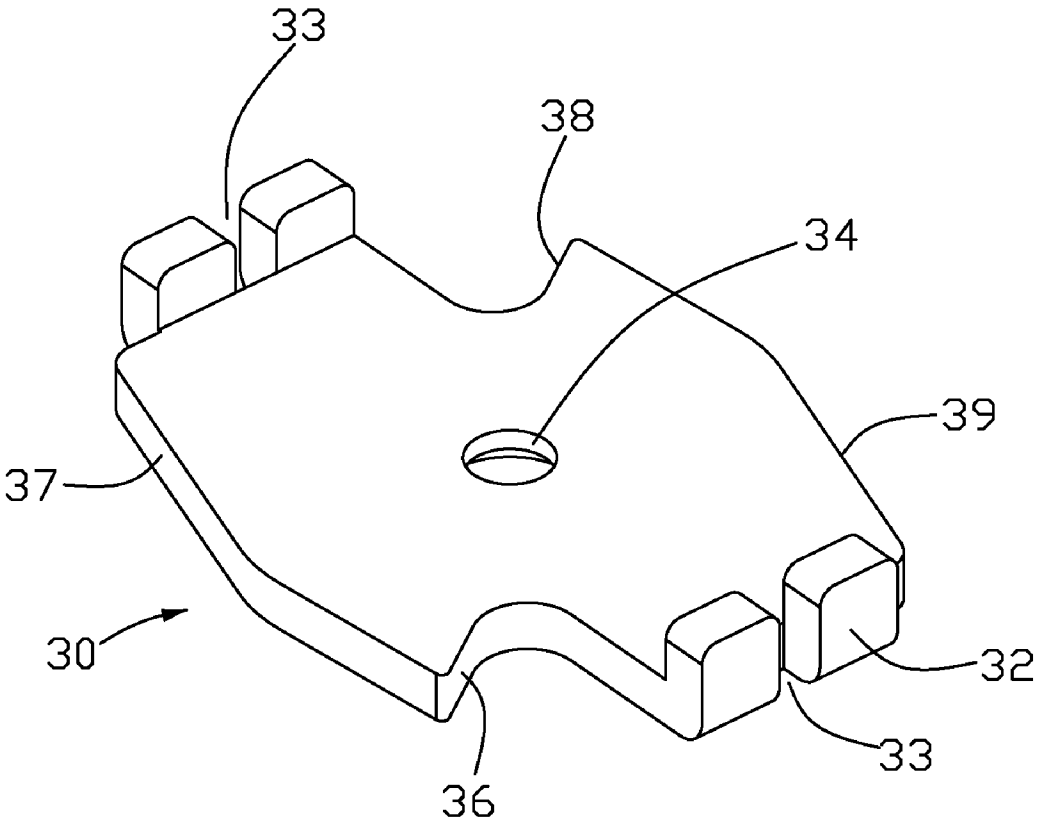
FIG. 4 is an enlarged view of a latch member of the slide rail assembly of FIG. 2.

Referring also to FIG. 4, the latch member 30 is a generally rectangular plate. Two sliding portions 32 extend from two opposite ends of the latch member 30 respectively. A gap 33 is defined in each sliding portion 32. A mounting hole 34 is defined in a center of the latch member 30. Two cutouts are defined in the latch member 30 at diagonally opposite corners of the latch member 30. The cutouts include a first stop surface 36 and a second stop surface 38, respectively. A first inclined surface 37 and a second inclined surface 39 are formed at the other two diagonally opposite corners of the latch member 30.

Figure 5:
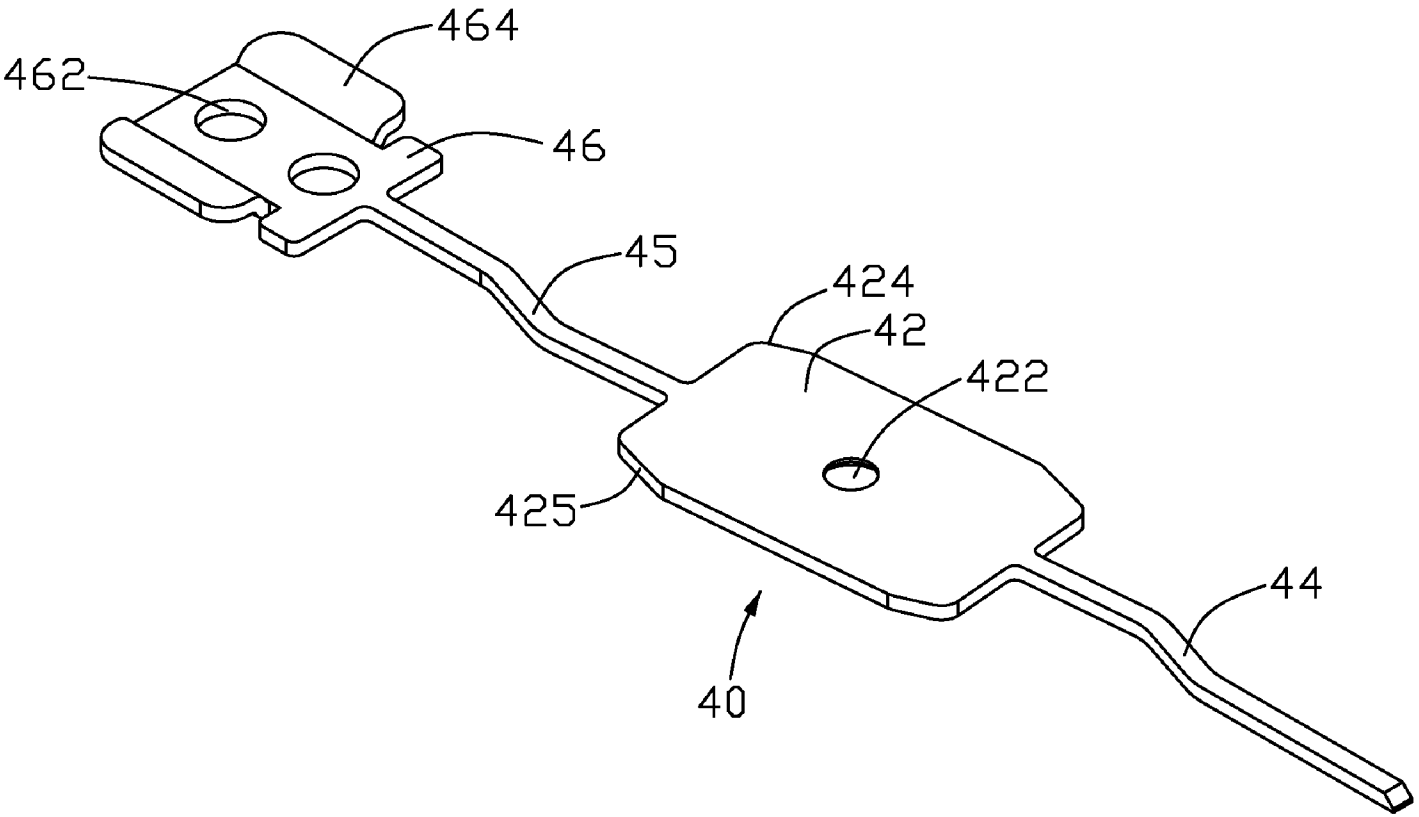
FIG. 5 is an enlarged view of a connecting member of the slide rail assembly of FIG. 3.

Referring also to FIG. 5, the connecting member 40 includes a generally rectangular main body 42, a first resilient portion 45 and a second resilient portion 44 extending from two opposite ends of the main body 42 respectively, and a mounting portion 46 formed from an end of the first resilient portion 45. A mounting hole 422 is defined in the center of the main body 42. The first and second resilient portion 45, 44 are generally elongated bars and each have a bent section at a middle thereof. A first inclined portion 424 and a second inclined portion 425 are formed at two corners of the main body 42 in the vicinity of the first resilient portion 45. Two mounting holes 462 are defined in the mounting portion 46 along a longitudinal line thereof. Two L-shaped bent tabs 464 are formed at opposite sides of the mounting portion 46.

Figure 6:
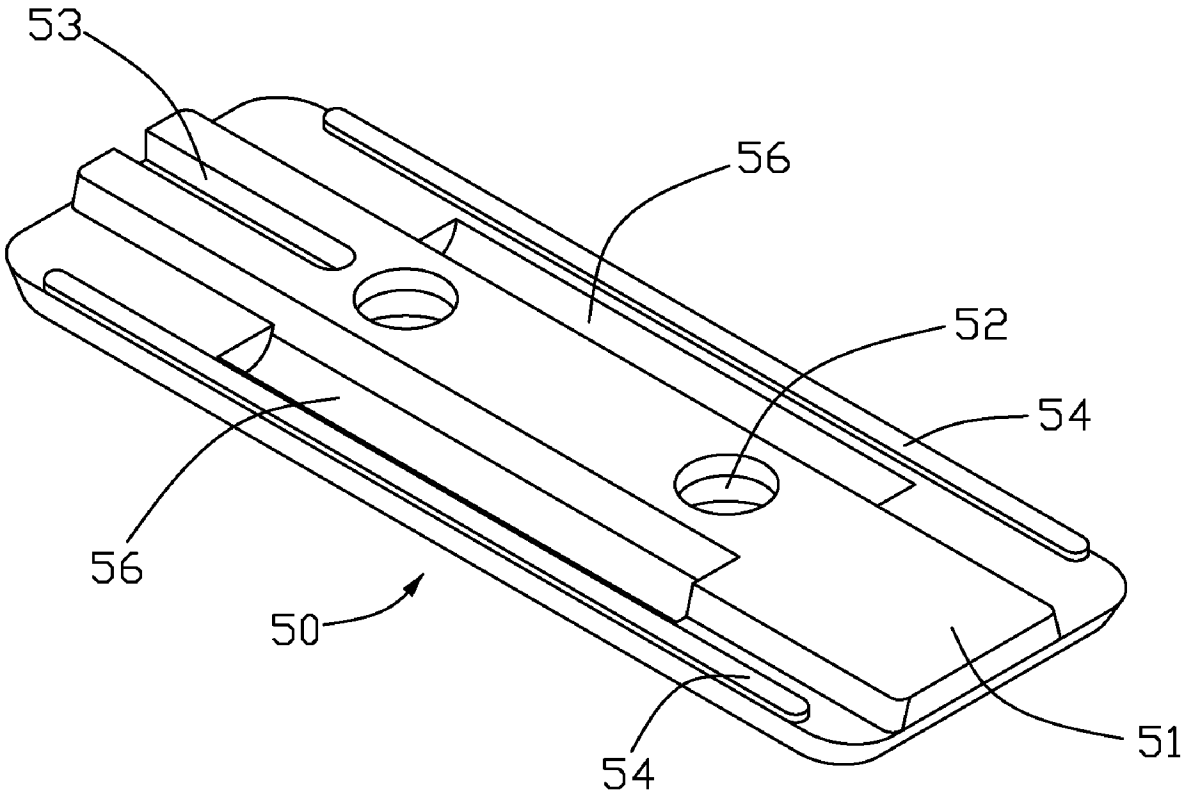
FIG. 6 is an enlarged view of a mounting member of the slide rail assembly of FIG. 2.

Referring also to FIG. 6, the mounting member 50 is generally rectangular. A protrusive flat portion 51 is formed from end to end along the longitudinal centerline of the mounting member 50. The flat portion 51 has two mounting holes 52 defined in a middle area thereof, and a channel 53 defined from one end thereof extending to near the nearest hole 52. Two elongate flanges 54 protrude from opposite sides of the mounting member 50 along the elongate direction, respectively. Two grooves 56 are defined in the mounting member 50 between the flat portion 51 and the flanges 54 respectively.

Referring to FIGS. 2 and 3, the first release member 62 is elongated. The first release member 62 includes an operating end, and a driving end. A mounting piece 621 extends from the operating end of the first release member 62. A button 622 is placed on the mounting piece 621. A cutout is defined in one side of the first release member 62 in the vicinity of the driving end. The cutout has a slanted sidewall configured as a first driving portion 623. A tab 624 extends from the side of the first release member 62 between the cutout and the mounting piece 621.

The second release member 64 is elongated, and includes an operating end and a driving end. The operating end has a button 642 attached thereto. A cutout is defined in one side of the second release member 64 in the vicinity of the driving end. The cutout has a slanted sidewall configured as a second driving portion 644. Two first tabs 646 extend from the one side of the second release member 64 in the vicinity of the driving end. A second tab 648 extends from the side of the second release member 64 in the vicinity of the operating end.

Figure 7:
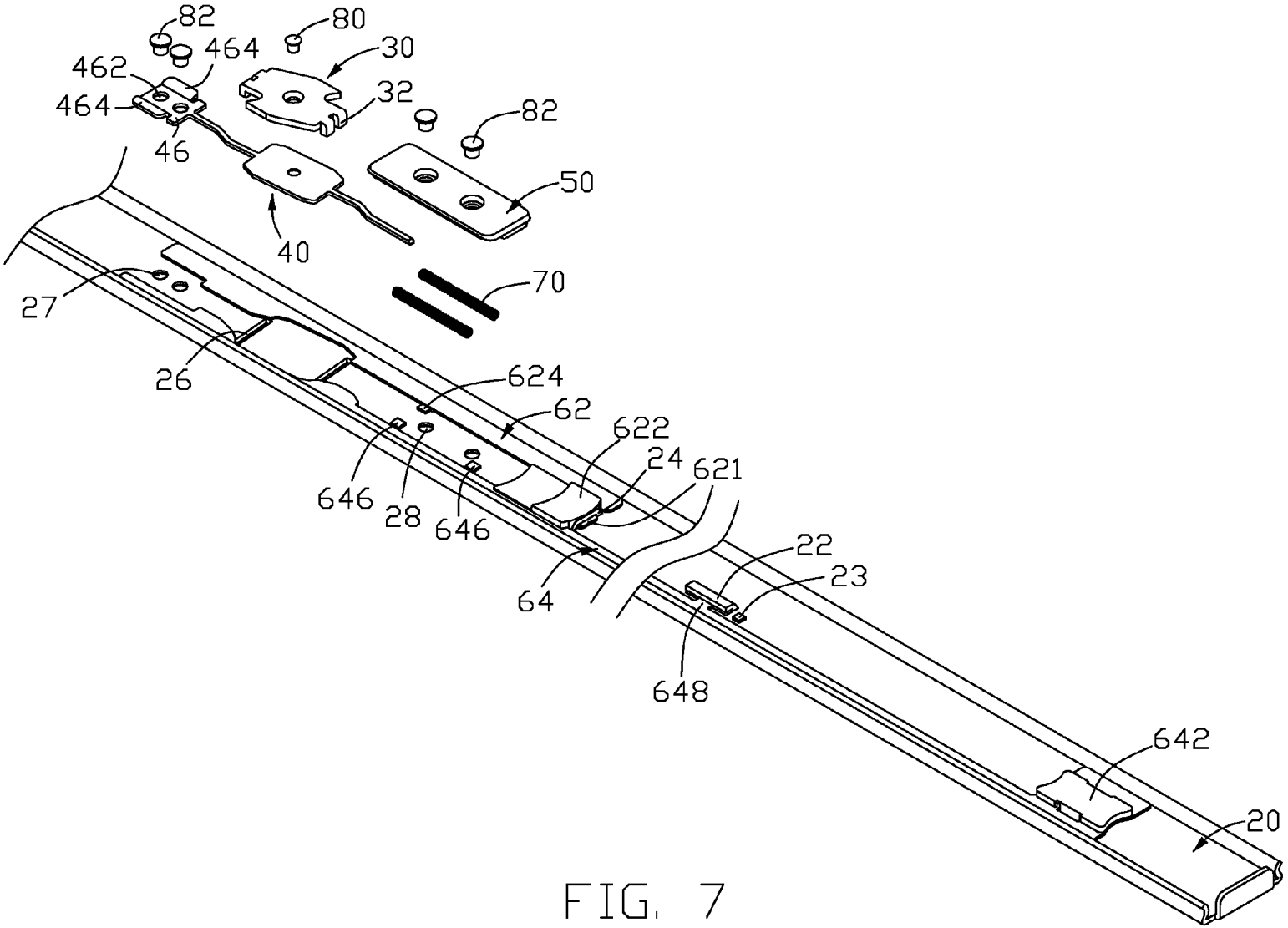
FIG. 7 is a partially assembled view of a part of FIG. 3.
Figure 8:
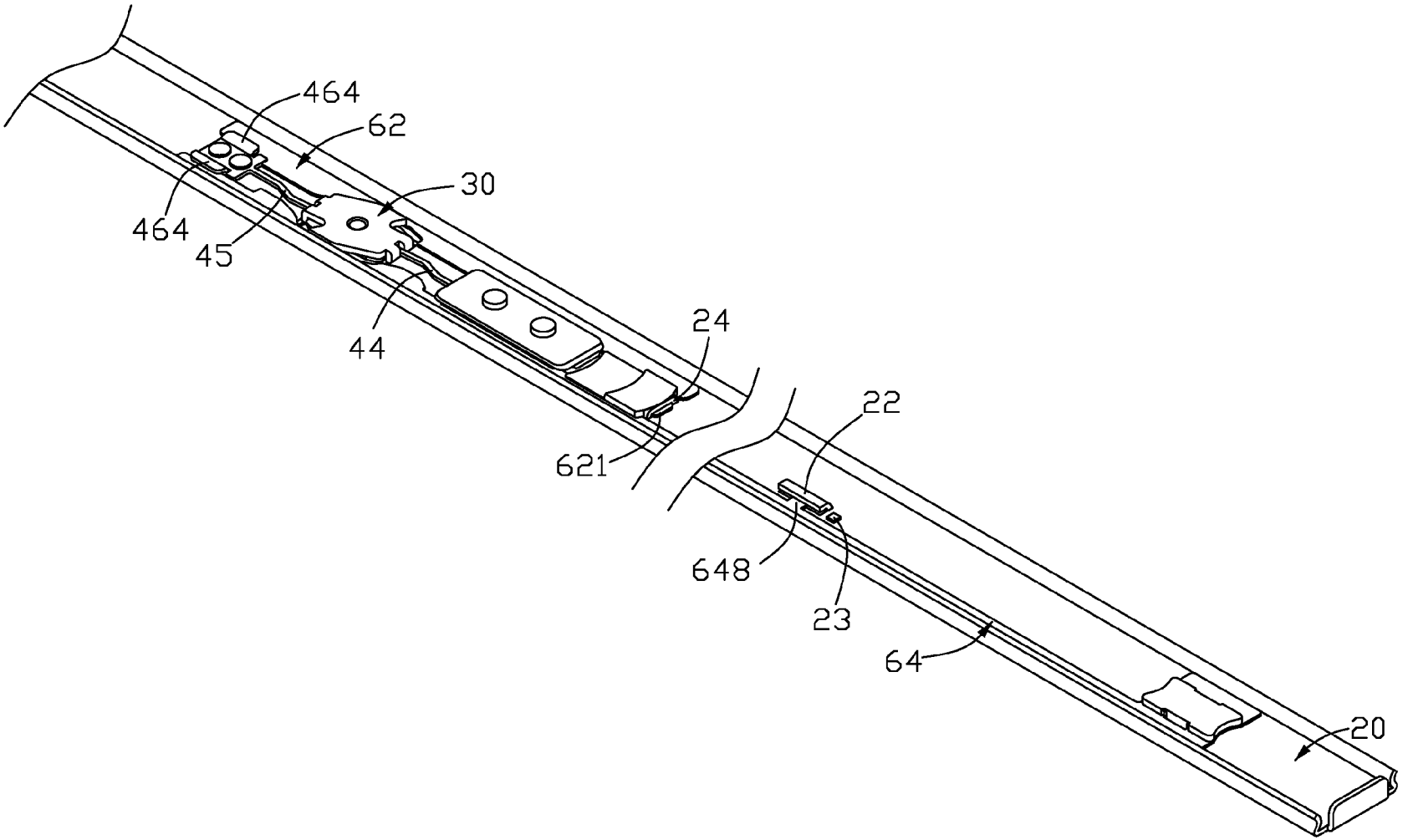
FIG. 8 is an assembled view of FIG. 7.

Referring also to FIGS. 7 and 8, in assembly, the first and second release members 62, 64 are oppositely arranged on the base wall of the second slide rail 20, and in the vicinity of the side walls of the second slide rail 20 respectively. The mounting piece 621 of the first release member 62 is received in the quadrate slot 25 of the second slide rail 20, and is fixed by the arch-like fixed portion 24 via an extension tab of the mounting piece 621 inserting into a slot formed between the arch-like fixed portion 24 and the base wall of the second slide rail 20. The second tab 648 of the second release member 64 is arranged under the bent tab 22 of the second slide rail 20. The block 23 of the second slide rail 20 is configured for blocking the second tab 648 to confine the second release member 64.

The latch member 30 is mounted to the connecting member 40 via the rivet 80 extending through the mounting hole 34 of the latch member 30 to engage in the mounting hole 422 of the main body 42 of the connecting member 40. The first and second resilient portions 45, 44 extend outward through the gaps 33 of the latch member 30 respectively. The assembly of the latch member 30 and the connecting member 40 is arranged on the base wall of the second slide rail 20. The sliding portions 32 are inserted into the sliding slots 26 of the second slide rail 20 respectively. The mounting portion 46 of the connecting portion 40 is mounted on the second slide rail 20 via two rivets 82 extending through the mounting holes 462 of the mounting portion 46 and engaging in the mounting holes 27 of the second slide rail 20 respectively. The driving ends of the first and second release members 62, 64 are slidably restrained under the bent tabs 464 of the mounting portion 46 of the connecting member 40.

The resilient members 70 are compressedly received in the grooves 56 of the mounting member 50 respectively. The mounting member 50 is mounted on the second slide rail 20 via the rivets 82 extending through the mounting holes 52 of the mounting member 50 and engaging in the mounting holes 28 of the second slide rail 20 respectively. The distal end of the second resilient portion 44 is restrained in the channel 53 of the mounting member 50. The first and second release members 62, 64 are pressed against the base wall of the second slide rail 20 by the flanges 54 of the mounting member 50 respectively. The tab 624 of the first release member 62 engages with one end of the corresponding resilient member 70. The first tabs 646 of the second release member 64 engage with opposite ends of the other corresponding resilient member 70 respectively.

Figure 9:
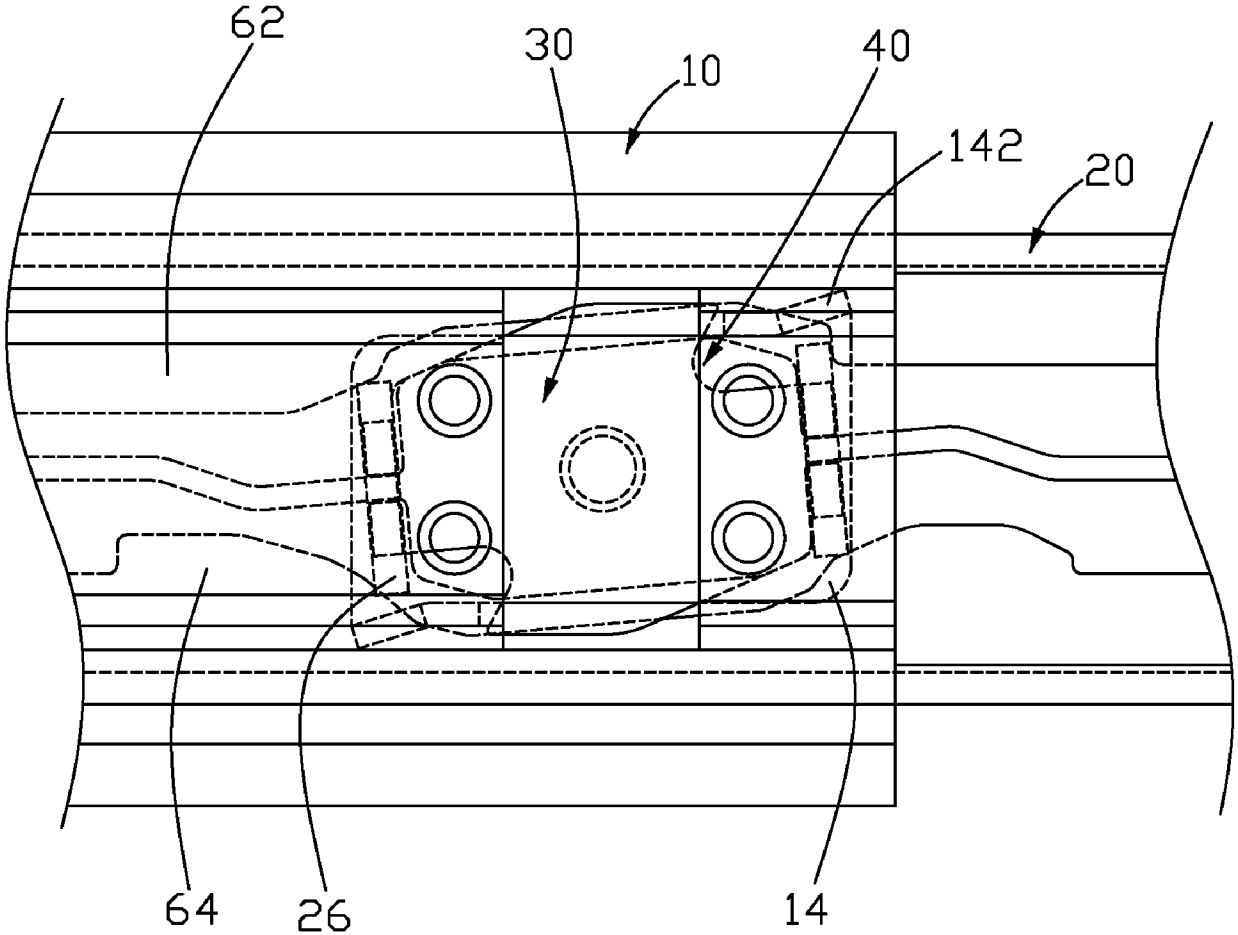
FIG. 9 is a lateral view of a part of the slide rail assembly of FIG. 1 in a first using state.
Figure 10:
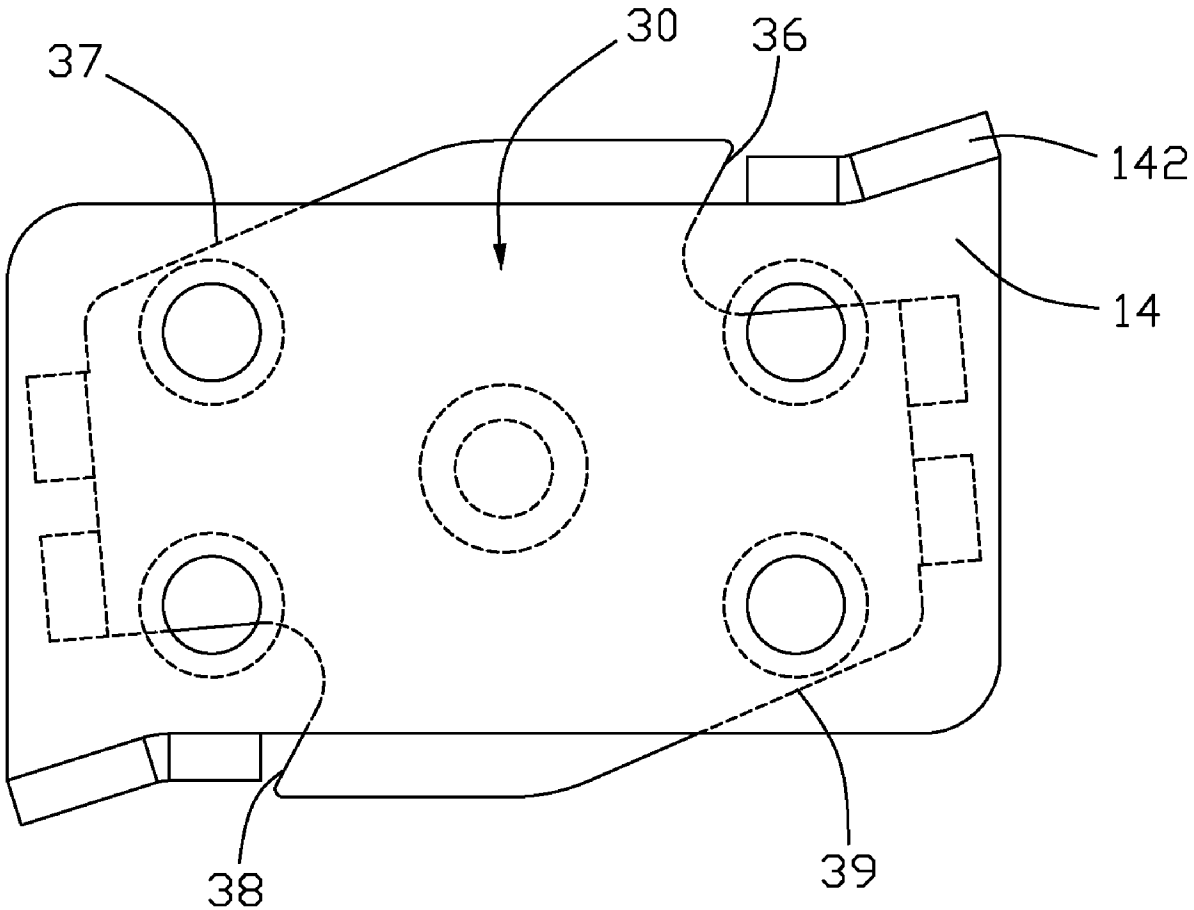
FIG. 10 is a sketch view showing a relative position between a stop member of the first slide rail and the latch member of FIG. 9.

Referring also to FIG. 9, when pushing the second slide rail 20 to slide into the first slide rail 10, the outer one of the protrusions 142 of the stop member 14 engages with the first inclined surface 37 of the latch member 30 to move the latch member 30 downwardly along the sliding slots 26 of the second slide rail 20 against the first and second resilient portions 45, 44 of the connecting member 40 until the latch member 30 rides over the outer one protrusion 142 of the stop member 14. Then the first and second resilient portions 45, 44 of the connecting member 40 rebound to return the latch member 30 to its original position, thus the latch member 30 is confined between the protrusions 142 of the stop member 14 to avoid the second slide rail 20 moving outward or inward relative to the first slide rail 10, as shown in FIG. 10. The first and second stop surfaces 36, 38 are engagable with the protrusions 142 of the stop member 14 respectively.

Figure 11:
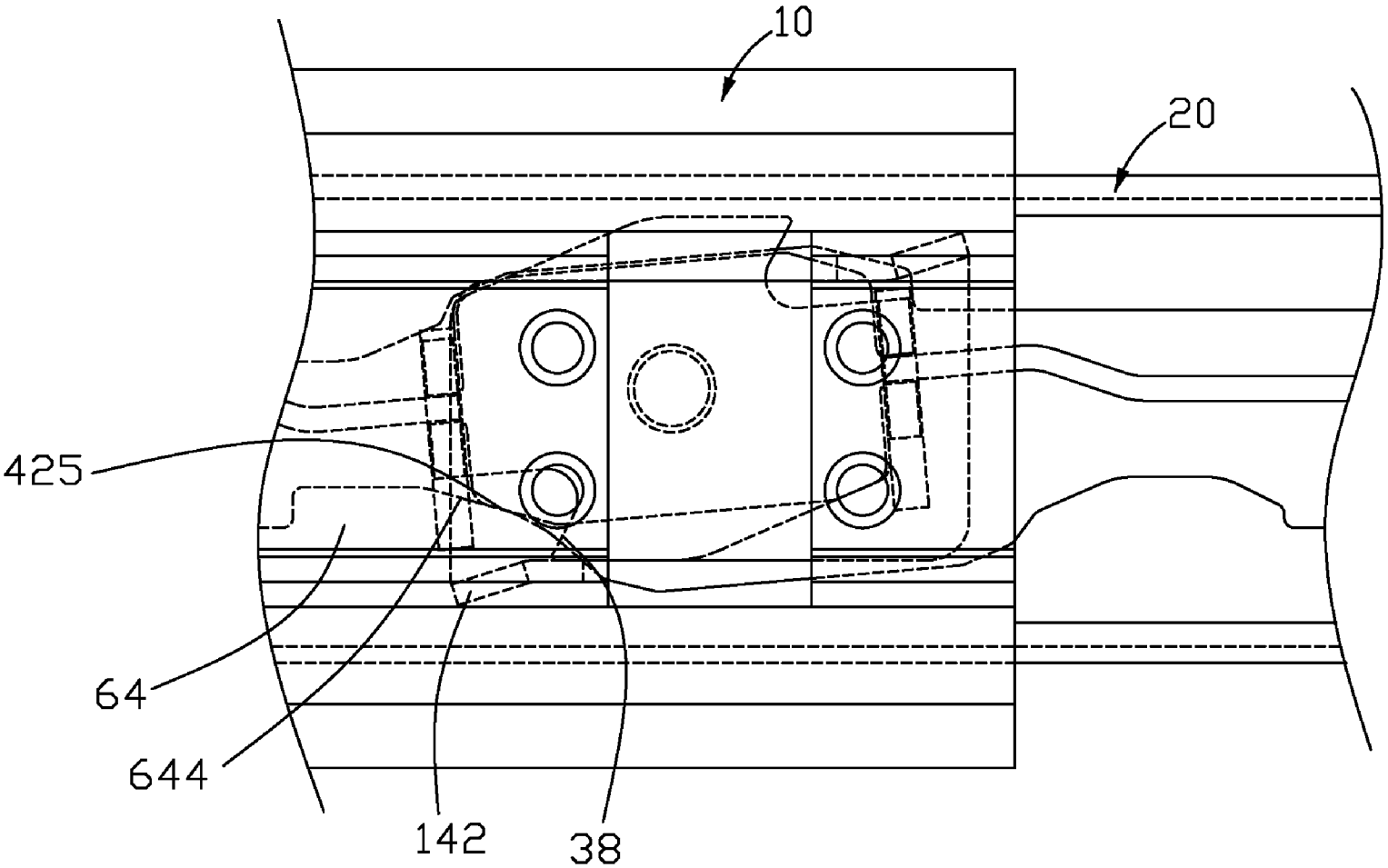
FIG. 11 is a lateral view of a part of the slide rail assembly of FIG. 1 in a second using state.
Figure 12:
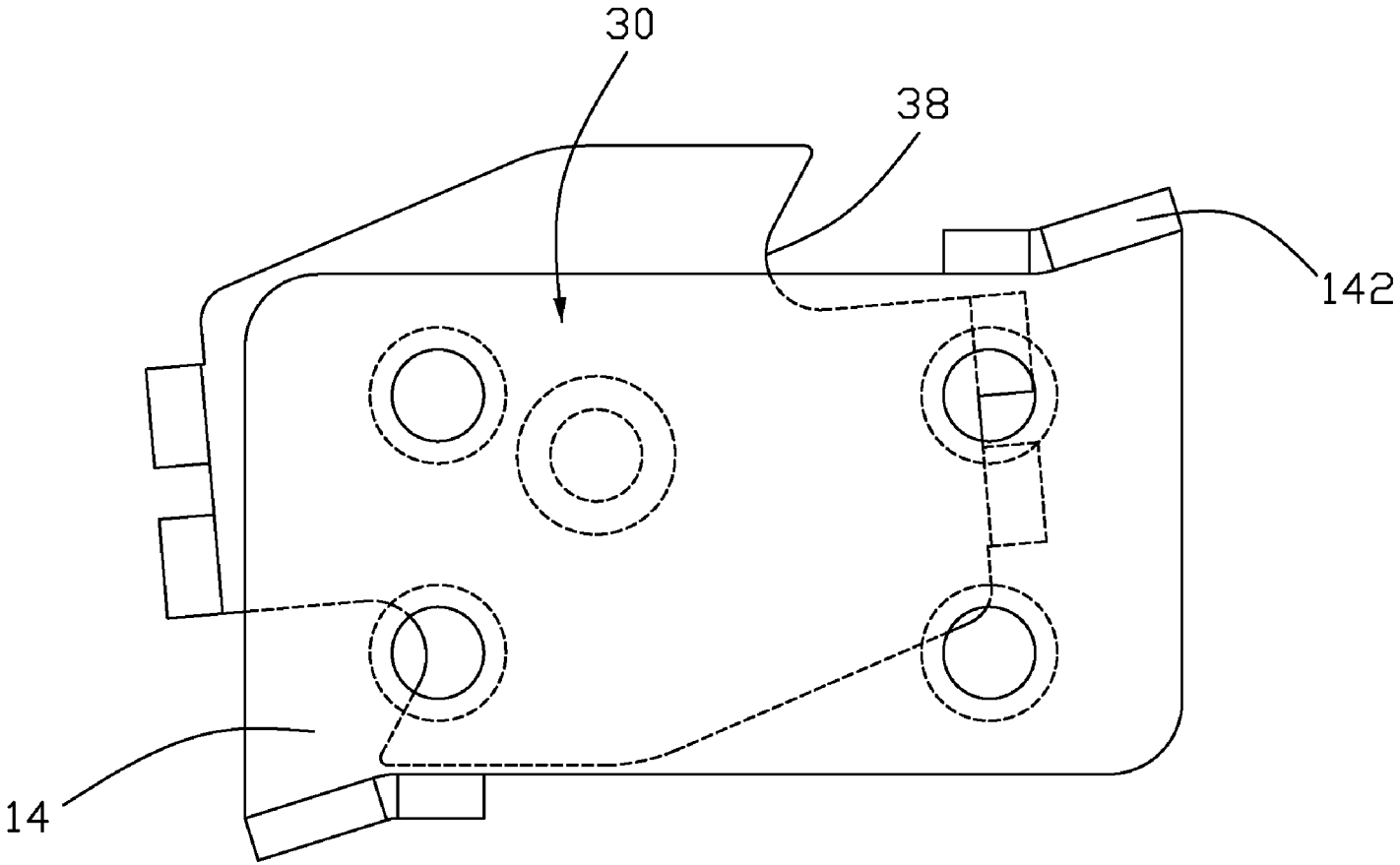
FIG. 12 is a sketch view showing a relative position between the stop member and the latch member of FIG. 11.

Referring also to FIG. 11, in moving the second slide rail 20 further inward relative to the first slide rail 10, pull the second release member 64 outward along the second slide rail 20. The second driving portion 644 of the second release member 64 engages with the second inclined portion 425 of the connecting member 40 to drive the latch member 30 upward along the sliding slots 26 of the second slide rail 20 against the first and second resilient portions 45, 44 of the connecting member 40. The second stop surface 38 of the latch member 30 disengages from the inner protrusion 142 of the stop member 14 which allows the second slide rail 20 to move inward without allowing an outward movement relative to the first slide rail 10, as shown in FIG. 12.

Figure 13:
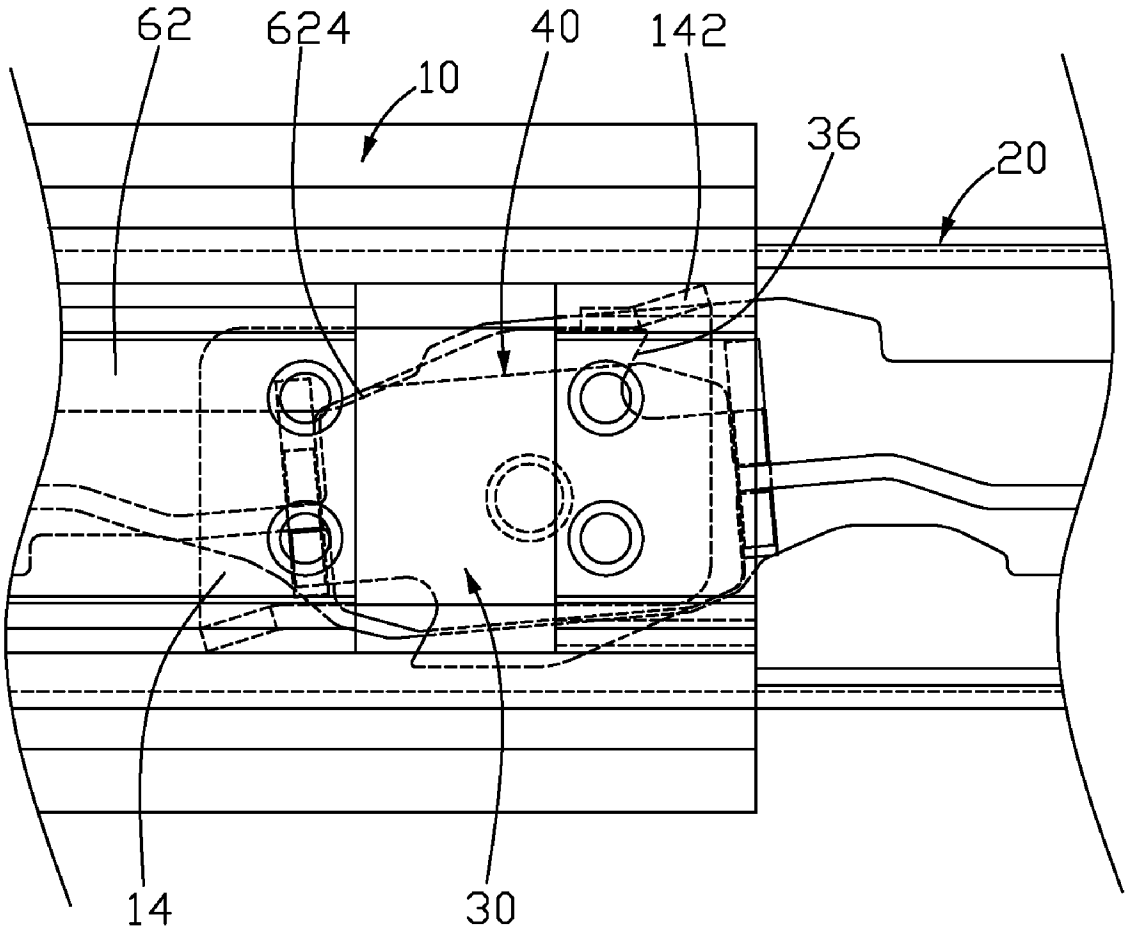
FIG. 13 is a lateral view of a part of the slide rail assembly of FIG. 1 in a third using state.
Figure 14:
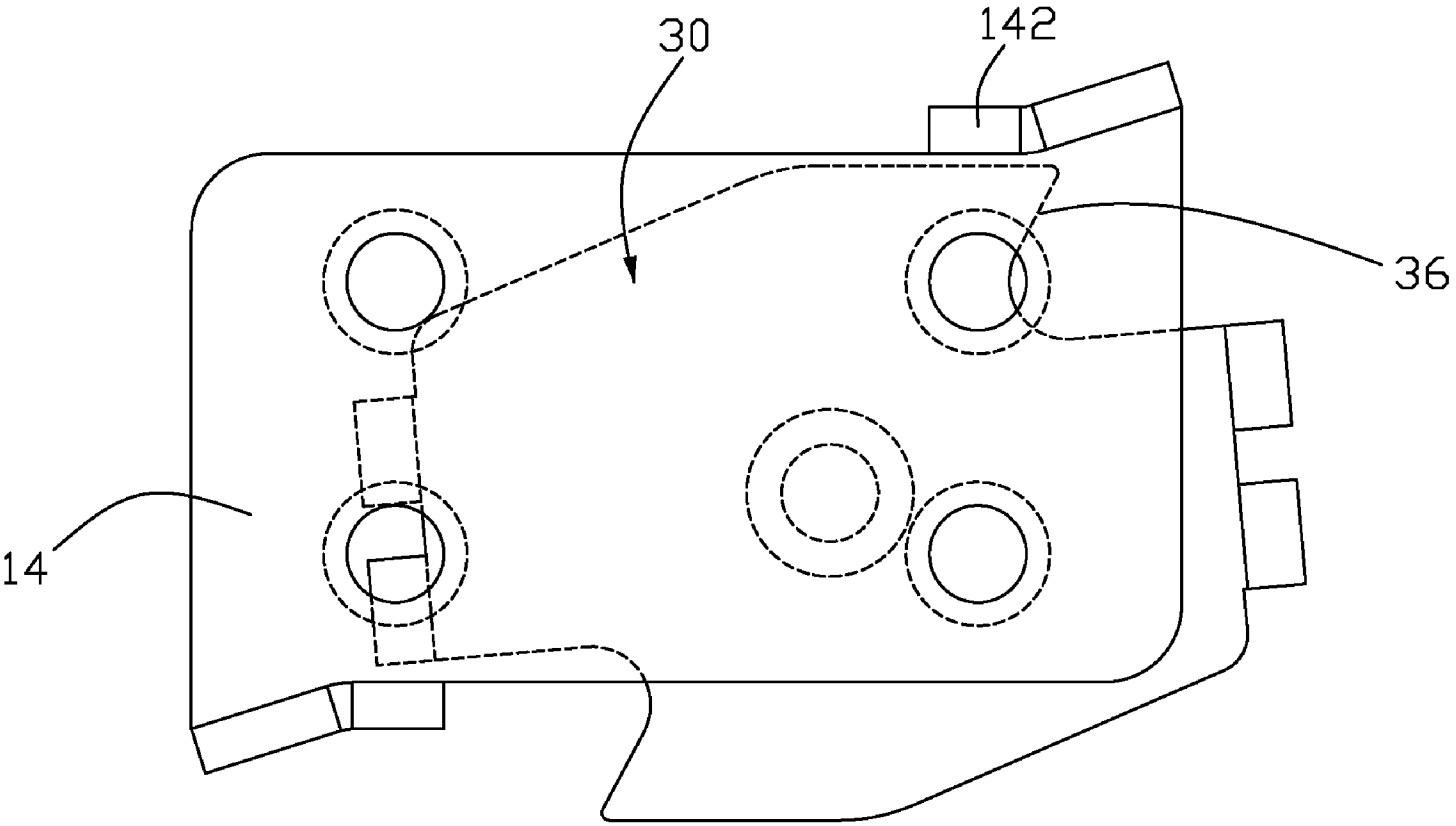
FIG. 14 is a sketch view showing a relative position between the stop member and the latch member of FIG. 13.

Referring also to FIG. 13, the same principle applies when pulling the first release member 62 outward along the second slide rail 20. The first driving portion 623 of the first release member 62 engages with the first inclined portion 424 of the connecting member 40 to slide the latch member 30 downwardly along the sliding slots 26 of the second slide rail 20 against the first and second resilient portions 45, 44 of the connecting member 40. The first stop surface 36 of the latch member 30 disengages from the outer protrusion 142 of the stop member 14 which allows the second slide rail 20 to move outward without allowing an inward movement relative to the first slide rail 10, as shown in FIG. 14.

When the latch member 30 leaves the protrusions 142 of the stop member 14, releasing the operating ends of the first or second release member 62, 64, the first and second resilient portions 45, 44 of the connecting member 40 rebound to return the latch member 30 to its original position. The resilient members 70 rebound to return the first or second release member 62, 64 to their original position respectively. The protrusions 142 may extend from the first slide rail 10 directly. The latch module including the latch member 30 and the connecting member 40 may be integrally formed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A latch mechanism for retaining a slide rail assembly which comprises a first slide rail and a second slide rail slidably attached to the first slide rail, comprising:

a latch module movably carried by the second slide rail, the latch module comprising a first stop surface and a second stop surface at opposite sides thereof respectively;

a stop member arranged on the first slide rail, two protrusions respectively extending from the stop member at diagonally opposite corners thereof configured to respectively engage with the first and second stop surfaces of the latch module for retaining the second slide rail relative to the first slide rail; and a first release member and a second release member slidably attached to the second slide rail, the first and second release members capable of selectively driving the latch module to slide the latch module to release the first or second stop surface from the corresponding protrusion of the stop member;

wherein the first release member is capable of being slid outward relative to the second slide rail to move the latch member downward to release the first stop surface from the corresponding protrusion thereby allowing the second slide rail being slid outward relative to the first slide rail, and the second release member is capable of being slid outward relative to the second slide rail to move the latch member upward to release the second stop surface from another corresponding protrusion thereby allowing the second slide rail being slid inward relative to the first slide rail.

2. The latch mechanism as described in claim 1, wherein the latch module comprises a connecting member movably connected to the second slide rail and a latch member fixed with the connecting member.

3. The latch mechanism as described in claim 2, wherein the connecting member has a main body, two inclined portions are formed at opposite sides of the main body respectively, the first release member has a first driving portion, the second release member has a second driving portion, the first and second driving portions are capable of selectively moving relative to the second slide rail in a longitudinal direction of the second slide rail to drive the corresponding inclined portion to move the main body with the latch member relative to the second slide rail in a lateral direction of the second slide rail to thereby release the first or second stop surface from the corresponding protrusion of the stop member.

4. The latch mechanism as described in claim 3, wherein a first resilient portion and a second resilient portion extend from opposite ends of the main body of the connecting member respectively in the longitudinal direction of the second slide rail, configured for returning the latch member to its original position.

5. The latch mechanism as described in claim 4, wherein the connecting member comprises a mounting portion arranged at one end of the first resilient portion, two bent tabs are formed from opposite sides of the mounting portion of the connecting member for confining the first and second release members respectively.

6. The latch mechanism as described in claim 4, further comprising a mounting member configured for fixing the second resilient portion on the second slide rail.

7. The latch mechanism as described in claim 6, wherein the mounting member has two flanges at opposite sides thereof respectively for slidably attaching the first and second release members to the second slide rail.

8. The latch mechanism as described in claim 4, wherein two sliding portions extend from opposite ends of the latch member, the second slide rail defines two parallel sliding slots for receiving the sliding portions of the latch member.

9. The latch mechanism as described in claim 8, wherein the parallel sliding slots of the second slide rail are not perpendicular to a longitudinal axis of the second slide rail.

10. The latch mechanism as described in claim 8, wherein two gaps are defined in sliding portions of the latch member for locking the first and second resilient portions of the connecting member respectively.

11. A slide rail assembly comprising:

a first slide rail having two protrusions arranged thereon;

a second slide rail slidably mounted to the first slide rail;

a connecting member movably arranged on the second slide rail;

a latch member mounted on the connecting member, the latch member comprising a first stop surface and a second stop surface respectively formed at diagonally opposite corners thereof, the first and second stop surfaces engaging with the respective protrusions of the first slide rail respectively for blocking the second slide rail from moving inward and outward relative to the first slide rail; and a first release member and a second release member slidably attached to the second slide rail, the first and second release members capable of selectively driving the connecting member to slide the latch member to release the first or second stop surface from the respective protrusion of the first slide rail respectively;

wherein the first release member is capable of being slid outward relative to the second slide rail to move the latch member downward to release the first stop surface from the corresponding protrusion thereby allowing the second slide rail being slid outward relative to the first slide rail, and the second release member is capable of being slid outward relative to the second slide rail to move the latch member upward to release the second stop surface from another corresponding protrusion thereby allowing the second slide rail being slid inward relative to the first slide rail.

12. The slide rail assembly as described in claim 11, wherein a first inclined surface and a second inclined surface are respectively formed at the other two diagonally opposite corners of the latch member.

13. The slide rail assembly as claimed in claim 11, wherein a bent tab extends up from the second slide rail to movably confine one side of the second release member.

14. The slide rail assembly as claimed in claim 11, further comprising two resilient members arranged between the first and second release members and the second slide rail respectively for returning the first and second release members back to their original positions.

15. The slide rail assembly as described in claim 11, wherein the connecting member has a main body mounted to the latch member, a first resilient portion and a second resilient portion extend from opposite ends of the main body of the connecting member respectively configured for returning the latch member to its original position, a free end of the first resilient portion is fixed relative to the second slide rail.

16. The slide rail assembly as described in claim 15, further comprising a mounting member fixed to the second slide rail configured for movably confining a free end of the second resilient portion.

17. The slide rail assembly as described in claim 16, wherein opposite sides of the mounting member movably confine the first and second release members to the second slide rail, two resilient members are arranged in two slots of the mounting member for respectively returning the first and second release members back to their original positions.

18. A slide rail assembly comprising:

a first slide rail comprising a forth stop portion and a back stop portion;

a second slide rail slidably mounted to the first slide rail in back-and-forth directions;

a latch member comprising a forth stop surface and a back stop surface, the latch member configured to be blocked between the forth stop portion and the back stop portion with the forth stop surface blocked by the forth stop portion in one of the back-and-forth directions and the back stop surface blocked by the back stop portion in the other one of the back-and-forth directions to thereby block the second slide rail from moving in the back-and-forth directions relative to the first slide rail;

a deformable and reboundable connecting member secured to the second slide rail and configured to maintain the latch member to be blocked between the forth stop portion and the back stop portion; and a first release member and a second release member slidably attached to the second slide rail, the first and second release members capable of selectively driving the connecting member to slide together with the latch member in one of up-and-down directions to thereby release the forth stop surface from the forth stop portion or release the back stop surface from the back stop portion;

wherein the second slide rail defines at least one sliding slot extending in a direction at an angle with respect to the back-and-forth directions, and the latch member forms at least one sliding portion slidably received in the at least sliding slot such that when the connecting member is driven by one of the first and second release members or restored, the latch member is driven to slide in the at least one sliding slot by the connecting member.

19. The slide rail assembly as described in claim 18, further comprising a mounting member fixed to the second slide rail, wherein one end of the connecting member is fixed to the second slide rail, an opposite end of the connecting member is slidably secured to the mounting member in the back-and-forth directions, two resilient members are arranged in two slots of the mounting member for respectively returning the first and second release members back to their original positions.

* * * * *